US010738401B2

(12) United States Patent
Sick et al.

(10) Patent No.: US 10,738,401 B2
(45) Date of Patent: Aug. 11, 2020

(54) MACHINE FOR MANUFACTURING ARTIFICIAL TURF

(71) Applicant: Polytex Sportbelage Produktions-GmbH, Grefrath (DE)

(72) Inventors: Stephan Sick, Willich-Neersen (DE); Dirk Sander, Kerken (DE); Thomas Leszinski, Nettetal (DE); Bernd Jansen, Nettetal (DE)

(73) Assignee: Polytex Sportbelage Produktions-GmbH, Grefrath (DE)

( * ) Notice: Subject to any disclaimer, the term of this patent is extended or adjusted under 35 U.S.C. 154(b) by 16 days.

(21) Appl. No.: 16/068,545

(22) PCT Filed: Mar. 21, 2017

(86) PCT No.: PCT/EP2017/056650
§ 371 (c)(1),
(2) Date: Jul. 6, 2018

(87) PCT Pub. No.: WO2017/162643
PCT Pub. Date: Sep. 28, 2017

(65) Prior Publication Data

US 2019/0017206 A1 Jan. 17, 2019

(30) Foreign Application Priority Data

Mar. 22, 2016 (EP) ..... 16161776

(51) Int. Cl.
*D05C 17/02* (2006.01)
*D01F 1/02* (2006.01)
(Continued)

(52) U.S. Cl.
CPC ..... *D05C 17/023* (2013.01); *D01F 1/02* (2013.01); *D02J 1/22* (2013.01); *D05C 17/00* (2013.01);
(Continued)

(58) Field of Classification Search
None
See application file for complete search history.

(56) References Cited

U.S. PATENT DOCUMENTS

| | | | | |
|---|---|---|---|---|
| 4,913,958 | A | 4/1990 | Skaggs et al. | |
| 2008/0050519 | A1 | 2/2008 | Hubbuch et al. | |
| 2010/0255223 | A1* | 10/2010 | De Vries | E01C 13/08 428/17 |

FOREIGN PATENT DOCUMENTS

| | | | |
|---|---|---|---|
| CA | 2429614 | A1 | 5/2002 |
| EP | 0044114 | A1 | 1/1982 |

(Continued)

OTHER PUBLICATIONS

Office Action for corresponding European Application No. 16161776.6 dated Nov. 20, 2018.
International Search Report for PCT/EP2017/056650, PCT/ISA/210 dated Dec. 6, 2017.
Written Opinion of the International Searching Authority for PCT/EP2017/056650,PCT/ISA/237 dated Dec. 6, 2017.

(Continued)

*Primary Examiner* — Jethro M. Pence
(74) *Attorney, Agent, or Firm* — Harness, Dickey & Pierce, P.L.C.

(57) ABSTRACT

A machine for manufacturing artificial turf includes a fiber inserter configured to incorporate artificial turf fiber into an artificial turf backing to form the artificial turf. The artificial turf includes an underside and an artificial turf surface. The machine further includes a coater configured to coat the underside with a colloidal latex coating. The colloidal latex coating has an exposed surface. The machine further includes an applicator configured to wett an exposed surface of the colloidal latex coating with an anti-blistering agent. The machine further includes a heater configured to heat the underside to cure the colloidal latex coating into a solid latex coating.

23 Claims, 2 Drawing Sheets

(51) Int. Cl.

| | |
|---|---|
| ***D02J 1/22*** | (2006.01) |
| ***D06C 7/02*** | (2006.01) |
| ***D06N 7/00*** | (2006.01) |
| ***E01C 13/08*** | (2006.01) |
| ***D05C 17/00*** | (2006.01) |
| *D01F 1/10* | (2006.01) |
| *D01D 5/12* | (2006.01) |

(52) U.S. Cl.

CPC ..... *D06C 7/02* (2013.01); *D06N 7/0065* (2013.01); *D06N 7/0071* (2013.01); *D06N 7/0073* (2013.01); *E01C 13/08* (2013.01); *D01D 5/12* (2013.01); *D01F 1/10* (2013.01); *D06N 2201/02* (2013.01); *D06N 2203/042* (2013.01); *D06N 2203/066* (2013.01); *D06N 2205/023* (2013.01); *D06N 2207/06* (2013.01); *D06N 2209/1685* (2013.01); *D06N 2211/066* (2013.01); *D10B 2505/202* (2013.01)

(56) References Cited

FOREIGN PATENT DOCUMENTS

| | | | |
|---|---|---|---|
| EP | 1076125 | A1 | 2/2001 |
| EP | 2894256 | A1 | 7/2015 |
| EP | 2940212 | A1 | 11/2015 |
| GB | 1195624 | A | 6/1970 |
| GB | 1461662 | A | 1/1977 |
| WO | WO-0061853 | A1 | 10/2000 |
| WO | WO-2009056284 | A1 | 5/2009 |
| WO | WO-2015144223 | A1 | 10/2015 |

OTHER PUBLICATIONS

International Preliminary Report On Patentability for PCT/EP2017056650, PCT/IPEA/409 dated May 16, 2018.

IWritten Opinion of the International Preliminary Examining authority for PCT/EP2017056650, PCT/IPEA/408 dated Feb. 20, 2018.

Office Action dated Jan. 25, 2019 for corresponding Canadian Application No. 3,008,577.

* cited by examiner

MACHINE FOR MANUFACTURING ARTIFICIAL TURF

CROSS-REFERENCE TO RELATED APPLICATIONS

This application is a national phase under 35 U.S.C. § 371 of PCT International Application No. PCT/EP2017/056650 which has an International filing date of Mar. 21, 2017 which claims priority to European Application No. 16161776.6, filed Mar. 22, 2016, the entire contents of each are hereby incorporated by reference.

FIELD OF THE INVENTION

The invention relates to artificial turf and the production of artificial turf, which is also referred to as synthetic turf. The invention further relates to the production of fibers that imitate grass, and in particular a product and a production method for artificial turf.

BACKGROUND AND RELATED ART

Artificial turf or artificial grass is surface that is made up of fibers which is used to replace grass. The structure of the artificial turf is designed such that the artificial turf has an appearance which resembles grass. Typically artificial turf is used as a surface for sports such as soccer, American football, rugby, tennis, golf, for playing fields, or exercise fields. Furthermore artificial turf is frequently used for landscaping applications.

An advantage of using artificial turf is that it eliminates the need to care for a grass playing or landscaping surface, like regular mowing, scarifying, fertilizing and watering. Watering can be e.g. difficult due to regional restrictions for water usage. In other climatic zones the re-growing of grass and re-formation of a closed grass cover is slow compared to the damaging of the natural grass surface by playing and/or exercising on the field. Artificial turf fields though they do not require a similar attention and effort to be maintained, may require some maintenance such as having to be cleaned from dirt and debris and having to be brushed regularly. This may be done to help fibers stand-up after being stepped down during the play or exercise. Throughout the typical usage time of 5-15 years it may be beneficial if an artificial turf sports field can withstand high mechanical wear, can resist UV, can withstand thermal cycling or thermal ageing, can resist inter-actions with chemicals and various environmental conditions. It is therefore beneficial if the artificial turf has a long usable life, is durable, and keeps its playing and surface characteristics as well as appearance throughout its usage time.

United States patent application publication US 20080050519 A1 discloses a latex formulation. The latex formulation comprises an aqueous emulsion of a natural or synthetic film-forming polymer, hydrogen peroxide, and an activating agent for hydrogen peroxide decomposition. A method of making a latex foam, a method of making a latex-coated textile material, a latex foam and latex foam coated articles are also disclosed.

European patent publication EP 2940212 A1 discloses a method of manufacturing artificial turf. The method comprising the steps of: creating a polymer mixture comprising at least one polymer and a nucleating agent for crystallizing the at least one polymer; extruding the polymer mixture into a monofilament; quenching the monofilament; reheating the monofilament; stretching the reheated monofilament to form the monofilament into an artificial turf fiber, wherein during the stretching the nucleating agent boosts the creation of crystalline portions of the at least one polymer within the monofilament; and incorporating the artificial turf fiber into an artificial turf backing, thereby mechanically fixing the monofilaments of the arranged artificial turf fibers in the artificial turf backing.

International patent publication WO 2009/056284 A1 discloses a method for the manufacture of artificial grass which consists of spraying onto the rear of the primary turf carpet a two- or three-component polyurethane product, that crosslinks rapidly, even at low temperatures, to give a compact, elastic, uniform and bubble-free film of a coating-adhesive, which shows an improved chemical and water resistance and bonds firmly the tufts to the primary web.

United States patent publication U.S. Pat. No. 4,913,958 A discloses substrates having successive layers of a cellular polyurethane and a noncellular polyurethane are prepared using certain siloxane-polyether block copolymers in the noncellular polyurethane formulation. The use of the block copolymer reduces or eliminates the formation of a bubble line at the interface of the polyurethane layers, thereby improving physical and cosmetic properties of the carpet.

SUMMARY

The invention provides for a machine and a system for manufacturing artificial turf in the independent claims. Embodiments are given in the dependent claims.

Artificial turf may for example include an athletic surface that is used as a substitute for a grass playing field or surface. Artificial turf may for example be used for surfaces that are used for sports, leisure, and landscaping. The artificial turf may take different forms depending upon the intended use. Artificial turf for football, baseball, soccer, field hockey, lacrosse, and other sports may have artificial turf fibers of varying thickness and length depending upon the requirements.

In one aspect the invention provides for a machine for manufacturing artificial turf. The machine comprises a fiber inserter configured for incorporating artificial turf fiber into an artificial turf backing to form the artificial turf. In some embodiments the fiber inserter may be a tufter. In other examples the fiber inserter may be a fiber weaving apparatus which may then weave the artificial turf fibers into the artificial turf backing. The artificial turf comprises an underside and an artificial turf surface.

The machine further comprises a coater configured for coating the underside with a colloidal latex coating. The colloidal latex coating has an exposed surface. The coater may be configured to apply the colloidal latex coating after the fiber inserter has incorporated the artificial turf fiber into the artificial turf backing. The machine further comprises an applicator configured for at least partially wetting an exposed surface of the colloidal latex coating with an anti-blistering agent. The applicator may be configured to wet the exposed surface of the colloidal latex coating after the colloidal latex coating has been applied by the applicator. The method further comprises a heater configured for heating at least the underside to cure the colloidal latex coating into a solid latex coating. The heater may be configured to heat the solid latex coating after the exposed surface of the colloidal latex coating has been applied by the applicator.

Applying the anti-blistering agent to the exposed surface of the colloidal latex coating may be beneficial because a larger amount of anti-blistering agent per weight of colloidal latex coating, can be used. This may result in a reduced amount of blistering of the solid latex coating. Anti-blistering agent can be mixed into the colloidal latex coating, however mixing the anti-blistering agent into the colloidal latex coating may affect the material or mechanical properties of the solid latex coating. Applying the anti-blistering agent to the exposed surface not only reduces the amount of blistering but the mechanical properties of the solid latex coating may also be maintained.

For example, US 20080050519 A1 does not disclose an applicator suitable for wetting an exposed surface of the colloidal latex coating with an anti-blistering agent before heating the colloidal latex coating. US 20080050519 A1 only discloses a heater.

In another embodiment the applicator is configured for spraying, atomizing, or aerosoling the anti-blistering agent onto or at least partially onto the exposed surface.

In another embodiment the applicator is a spray bar.

In another embodiment the coater comprises a lick roll or the coater comprises a dispenser configured for dispensing the colloidal latex coating with a knife over roll applicator for leveling or spreading the dispensed colloidal latex coating.

In another embodiment the heater comprises a first heat control element for maintaining a first temperature range across the underside. The heater further comprises a second heat control element for maintaining a second temperature range across the artificial turf surface. The first temperature range is larger than the second temperature range.

In another embodiment the first heat control element is a first forced air element. The second heat control element is a second forced air element. It may be beneficial to use forced air because this may result in more effective control of the temperature of the underside and the artificial turf surface. For example the forced air could be used to be blown through the artificial turf surface and thereby prevented from acting as insulation which causes artificial turf fibers to be overheated.

In another embodiment the first temperature range is any one of the following: between 140° C. and 150° C., between 130° C. and 160° C., between 120° C. and 170° C., and between 100° C. and 180° C.

In another embodiment the second temperature range is any one of the following: between 50° C. and 70° C., between 40° C. and 80° C., between 30° C. and 90° C., and between 20° C. and 100° C.

In another embodiment, the heater comprises a heating element.

In another embodiment, the heating element is a a forced air element.

In another embodiment, the heating element is a heat lamp.

In another embodiment, the heating element is a resistive heating element.

In another embodiment, the machine is configured for moving the artificial turf through the heater continuously.

In another embodiment, the applicator is configured for continuously wetting the exposed surface before the artificial turf enters the heater.

In another embodiment the machine is configured for manufacturing the artificial turf as a continuous process. For example a roll of artificial turf backing could be continuously manufactured into a roll of artificial turf.

In another embodiment, the machine is configured to move the artificial turf or the artificial turf backing of the artificial turf at a rate between 1 meter per minute and 5 meters per minute. This embodiment may be beneficial because the anti-blistering agent has time to mix or diffuse into a top layer of the exposed surface. This may aide in reducing the blistering.

In another embodiment the applicator is configured for wetting a region of the exposed surface of the colloidal latex coating with the anti-blistering agent. The machine is further configured for moving the region of the exposed surface into the heater within a time period of 10 second to 2 minutes. This embodiment may be beneficial because the anti-blistering agent has time to mix or diffuse into a top layer of the exposed surface. This may aide in reducing the blistering.

In another embodiment, the applicator is configured for wetting a region of the exposed surface of the colloidal latex coating with the anti-blistering agent. The heater has a heater entrance for the artificial turf. The the distance between the region of the exposed surface and the heater entrance is between 0.15 meters and 10 meters. This embodiment may be beneficial because the anti-blistering agent has time to mix or diffuse into a top layer of the exposed surface. This may aide in reducing the blistering.

In another embodiment the applicator of the machine is loaded with the anti-blistering agent.

In another embodiment, the machine comprises an anti-blistering agent reservoir that is configured for being at least partially filled with the anti-blistering agent. The anti-blistering agent reservoir may be fluidically connected to the applicator and supply the applicator with the anti-blistering agent. The anti-blistering agent reservoir as used herein is a reservoir or tank for holding a fluid. The applicator could for example be loaded with the anti-blistering agent by at least partially filling the anti-blistering agent reservoir with the anti-blistering agent.

The underside is heated by the machine to the cure the colloidal latex coating into a solid latex coating. When the colloidal latex coating is heated water is forced out of the colloidal latex coating. A skin or partially dried latex coating can form on the surface of the colloidal latex coating as it is being dried. Water may then be trapped underneath this thin skin surface which then may be ruptured as the water turns into steam. This may cause blistering of the solid latex coating. An anti-blistering agent is the material that causes the latex to coagulate a bit. This coagulation of the latex leaves areas where the water can escape without causing the blistering.

Anti-blistering agents may be added to the liquid colloidal latex coating before it is coated on the underside. In large enough quantities, the anti-blistering agents may make the colloidal latex unstable. Depending upon the type of anti-blistering agent, there is therefore a limit as to how much anti-blistering agent can be used. Also various anti-blistering agents may be unsuitable to store with a liquid latex for longer periods of time. Wetting the exposed surface of the anti-blistering agent may have the technical effect that larger concentrations of anti-blistering agent can be used. Wetting the exposed surface may also have the technical effect that the amount of blistering is greatly reduced. Reducing the blistering may also have the technical effect that the cured latex holds the artificial turf tufts better in place to the backing.

When a blistering agent is applied to the exposed surface, there may be limited remixing of the colloidal latex and the anti-blistering agent at the surface. This may have the effect of preventing a film or reducing film formation at the exposed surface of the colloidal latex. This disruption or partial disruption of film formation may be caused coagulation of the latex near the surface. This may then reduce the blistering during drying because moisture is able to escape instead of being trapped by a film.

Various types of anti-blistering agents may be used. For example a colloidal latex such as carboxylated styrene butadiene latex may be stabilized by an anionic surfactant which is located at the particle surface and by the carboxylic acid groups which are incorporated into the polymer. When neutralized the anionic surfactant and carboxylic groups will generate a negative charge, this negative charge will result in an electrostatic repulsion that will prevent the particles from agglomerating and ensure the colloidal stability of the latex. When this electrostatic repulsion is reduced, the particles are destabilized and are able to agglomerate which will lead to loss of colloidal stability and thus coagulation of the latex particles. This reduction of electrostatic repulsion can be obtained by adding an $H^+$-donor or a cationic species. The first can be considered as a pH induced coagulation, by adding an $H^+$-donor (e.g. an acid like citric acid) the charge on both the anionic surfactant and carboxylic acid will be neutralized leading to coagulation through charge neutralization. The second can be considered as a cationic induced coagulation, by adding species with a countercharged nature the electrostatic repulsion will be reduced again leading to coagulation through charge neutralization. Suitable cationic species can be salts like NaCl, $CaCl_2$ or $AlCl_3$ or polymers like polydiallyldimethylammonium chloride or polyethylenimine.

In another embodiment, the anti-blistering agent is an acid. Acids in general may cause the colloidal latex to undergo coagulation. This coagulation caused by acids in general may be undesirable when the colloidal latex is stored prior to being coated onto the underside. Spraying the acid on the surface may therefore be a way of using the acid to effectively reduce blistering when manufacturing a tufted surface covering.

In another embodiment, the acid is citric acid. The use of citric acid may be beneficial because it may be an effective anti-blistering agent when wetted on the exposed surface. It may also have the benefit of being a naturally organic acid which is non-toxic.

In another embodiment, the acid is vinegar or acetic acid. The use of vinegar or acetic acid may be beneficial because it is a naturally occurring organic acid which is non-toxic.

The use of an acid in general may be beneficial because it may have the technical effect of delaying the complete solidification of the colloidal dispersion of the latex particles during curing and thus reduce the chances of blistering.

In another embodiment, the acid is any one of the following: citric acid, vinegar, acetic acid, an alcohol, an organic acid, an inorganic acid, a sulfonic acid, a mineral acid, Formic acid, Acetic acid, Propionic acid, Butyric acid, Valeric acid, Caproic acid, Oxalic acid,Lactic acid, Malic acid, Citric acid, Benzoic acid, Uric acid, Taurine, p-Toluenesulfonic acid, Trifluoromethanesulfonic acid, Aminomethylphosphonic acid, tartaric acid, malic acid, phosphoric acid, hydrochloric acid, hexanedionic acid, and combinations thereof.

After drying, The resulting latex layer on the backing which attaches the tuft fibers may have a thickness of about 1 mm. When sprayed with an acid a tenth of a millimeter on the very surface of the latex film may have a relatively low pH. Typically when tufted surface coverings are manufactured a silicon polyether compound may be added to the bulk liquid colloidal latex before it is coated. Typically very small amounts of acid or anti-blistering agent are used, for example an order of 400 g per 1 metric ton of latex. In practice between 50 g and 1000 g of acid or anti-blistering agent per 1 metric ton of latex may be used. In another example between 200 g and 800 g of latex or anti-blistering agent per metric ton of latex may be used. In yet another example between 300 g to 500 g of acid or anti-blistering agent may be used.

When an anti-blistering agent is sprayed on the surface much larger concentrations of anti-blistering agent can be used. For example enough of the anti-blistering agent can be sprayed onto the surface such that there is about 1% of the anti-blistering agent on the surface as opposed to 0.04%. Spraying of the anti-blistering agent on the surface may therefore greatly reduce the blistering of the solid latex coating that results. If the tufted surface covering is manufactured in a continuous or web-based process the tufted surface covering may move between different stations when the method is performed. For example the underside may be coated with a lick roll or other coating system and then wetted by spraying or atomizing the anti-blistering agent onto the surface.

In the colloidal latex coatings that are typically used for making tufted surface coverings there may be a great deal of water. For example, the dried film may have an approximate weight of 1 kg per square meter of the backing material. Before the colloidal latex coating is dried, it may have a weight of 1.3 kg. This means that approximately 300 g of water need to be evaporated per meter.

Various apparatuses may be used for applying the anti-blistering agent. For example an atomized citric acid fog or an aerosol may be used.

In another embodiment the anti-blistering agent is a cationic-anti-blistering agent. A cationic-anti-blistering agent is an anti-blistering agent that may supply a cation which encourages the colloidal latex to clot. For example various salts may be used as a cationic-anti-blistering agent. This may be beneficial because the resulting solid latex coating may be produced without the uses of acid.

In another embodiment the cationic-anti-blistering agent is any one of the following: a salt, sodium chloride, calcium chloride, aluminum chloride, and aluminum sulfate.

In another embodiment the cationic-anti-blistering agent is a water-soluble cationic polymer. The water-soluble cationic polymers are not salts but still supply a cation which may be used to provide the anti-blistering effect.

Examples of several water-soluble cationic polymers that work are Polydiallyldimethylammonium chloride and Polyethylenimine.

Another coagulation mechanism of colloidal latexes, such as carboxylated latexes, is heat sensitization by addition of a polyether modified polysiloxane, this can be referred to as temperature induced coagulation. The mechanism of such heat sensitization may possibly be due to the formation of the polyether with the carboxylic acids on the particle surface, this may shield the electrostatic repulsion but will stabilize the particle trough sterical hindrance. When the cloud point of the polysiloxane is reached there will be no more stabilization trough sterical hindrance nor due to electrostatic repulsion and coagulation will be induced.

In another embodiment, the coater is loaded with the colloidal latex coating.

In another embodiment, the anti-blistering agent is a colloidal latex coagulant.

In another embodiment, the anti-blistering agent comprises a colloidal latex coagulant.

In another embodiment, the machine comprises a latex reservoir that is configured for being at least partially filled with the colloidal latex coating. The latex reservoir may be fluidically connected to the coater and supply the coater with the colloidal latex coating. The latex reservoir as used herein is a reservoir or tank for holding a fluid. The coater could for example be loaded with the colloidal latex coating by at least partially filling the latex reservoir with the colloidal latex coating.

In another embodiment, the colloidal latex coating further comprises a temperature-sensitive latex coagulant. A temperature-sensitive latex coagulant is a material which functions as an anti-blistering agent and becomes active when the colloidal latex coating is heated to drive water from it and turn it into the solid latex coating. The use of the temperature-sensitive latex coagulant in conjunction with the anti-blistering agent that is sprayed onto the exposed surface may further provide for a solid latex coating which has greatly reduced blistering defects. Temperature-sensitive latex coagulants are typically used to reduce blistering when manufacturing a tufted surface covering. The use of these temperature-sensitive latex coagulants with the additional sprayed anti-blistering agent may provide for even greater reduction in blistering defects.

In another embodiment, the temperature-sensitive latex coagulant is a silicone polyether.

In another embodiment, the temperature-sensitive latex coagulant is a polyether modified polysiloxane.

In another embodiment, the colloidal latex coating comprises an emulsion of styrene-butadiene.

In another embodiment, the machine is configured for continually processing artificial turf backing into the artificial turf. In one example, this could mean that the machine is configured for continually processing a roll of artificial turf backing into artificial turf.

In another embodiment, the machine is loaded with the artificial turf fiber. For example, the machine may be configured for receiving one or more spools of artificial turf fiber for use by the fiber inserter.

In another embodiment, the artificial turf fiber comprises a polymer mixture comprising at least one polymer. The artificial turf fiber is a stretched artificial turf fiber. The use of stretched artificial turf fiber may be beneficial because the stretching process may increase crystallization in the artificial turf fiber. The increased crystallization may make the surface rougher. This increased surface roughness increase the adhesion between the artificial turf fiber and the cured latex rubber. As the latex has reduced blistering the combination it also contributes to increasing the adhesion between the artificial turf fiber and the backing.

In another embodiment, the polymer mixture further comprises a nucleating agent for crystallizing the at least one polymer. This may further increase the adhesion between the artificial turf fiber and the cured lated.

In another embodiment, the nucleating agent may be an inorganic and/or an organic substance or a mixture thereof.

In another embodiment, the inorganic nucleating agent consists of one of the following items or a mixture thereof:

- talcum;
- kaolin (also known as "china clay");
- calcium carbonate;
- magnesium carbonate;
- silicate:
  - aluminium silicate and ; as e.g. sodium aluminosilicate (in particular zeolithes of natural and synthetic origin);
  - amorphous and partially amorphous silica and mixed morphologies hereof, e.g. fumed silica;
- silicic acid and silicic acid esters; e.g. tetraalkyl orthosilicate (also known as orthosilicic acid ester)
- aluminium trihydrate;
- magnesium hydroxide;
- meta- and/or polyphosphates; and
- coal fly ash (CFA); coal fly ash is a fine recovered e.g. from coal-fires of electric generation power plants.

In another embodiment, the organic nucleating agent comprises one of the following items or a mixture thereof:

- 1,2-cyclohexane dicarbonic acid salts (also known as main component of "Hyperform®"); in particular calcium salts of the 1,2-cyclohexane dicarbonic acid;
- benzoic acid;
- benzoic acid salt; the benzoic acid salt may be, in particular, an alcaline metal salt of the benzoic acid (e.g. sodium and potassium salts of the benzoic acid); and an alkaline earth metal salt of the benzoic acid (e.g. magnesium and calcium salts of the benzoic acid);
- sorbic acid; and
- sorbic acid salt. The sorbic acid salt may be, in particular, an alcaline metal salt of the sorbic acid (e.g. sodium and potassium salts of the sorbic acid); and an alkaline earth metal salt of the sorbic acid (e.g. magnesium and calcium salts of the sorbic acid).

In another aspect, the invention provides for manufacturing system. The manufacturing system comprises a machine according to an embodiment and an artificial turf fiber apparatus. The artificial turf fiber apparatus comprises:

- a polymer mixer configured for creating a polymer mixture, wherein the polymer mixture comprises at least one polymer;
- an extruder configured for extruding the polymer mixture into a monofilament;
- a quencher for quenching the monofilament after extrusion;
- a heater for reheating the monofilament after quenching; and
- a fiber stretcher for stretching the reheated monofilament to align the fibers relative to each other and to form the monofilament into the artificial turf fiber.

The stretched artificial turf fiber may for example be manufcacutred using one or more of the following steps:

- extruding the polymer mixture into a monofilament; to perform this extrusion the polymer mixture may for instance be heated;
- quenching the monofilament; in this step the monofilament may be cooled;
- reheating the monofilament;
- stretching the reheated monofilament to form the monofilament into an artificial turf fiber; during the stretching, the nucleating agent boosts the creation of crystalline portions of the at least one polymer within the monofilament; said boosting increases the surface roughness of the monofilament; and
- incorporating the artificial turf fiber into an artificial turf backing.

Said features may be advantageous as said method allows to strongly fix the artificial turf fiber within the backing, thereby providing an artificial turf that is more durable to mechanical stress, in particular in respect to mechanical pulling forces exerted on the fibers.

Said features may in particular allow to firmly attach several kinds of polyolefines used for artificial turf production, e.g. polyethylene (PE), to a backing of the artificial turf. Embodiments of the invention may lead to an increased life expectancy of artificial turf made from PE and similar polyolefines. Artificial turf and the fibers contained therein face a significant mechanical stress if used e.g. on a sports field. Fibers may become detached from the backing if, for example, a player abruptly stops or changes direction and thereby exerts a high pulling force on a fiber. The above described method of mechanically fixing turf fibers in the backing of artificial turf may result in the provision of a more durable kind of artificial turf which is specially suited for being used on a sports field.

In a further beneficial aspect, it has been observed that the fixing is based on mechanical forces, not on covalent bonds. The solidified fluid tightly surrounds and embeds protrusions and depressions of surface of the fiber. Said protrusions and depressions have been observed to be caused by the crystals. Thus, by adding the nucleating agent, the relative fraction of crystalline portions relative to amorphous portions of the at least one polymer may be increased, resulting in a rougher surface of the monofilaments and thus also in a rougher surface of the fibers and an increased mechanical grip exerted by the solidified fluid on the fiber. Fixing the fiber mechanically is advantageous, as it allows to firmly attach the fiber to any kind of backing material that can be applied as a fluid on the back side of the carrier and that solidifies after some time. Thus, fibers of a variety of different chemical compositions may be firmly embedded in a plurality of chemically divers backing materials. It is not necessary to prepare the fiber or the backing to be able to covalently bind to each other. This eases the manufacturing process and avoids the production of undesired byproducts. Thus, additional costs related to disposing chemical waste may be avoided and a broader combinatorial spectrum of fiber substances and backing substances that can be combined for creating artificial turf may be available.

Extruding the polymer mixture into a monofilament rather than a polymer film may be advantageous, because it has been observed that the process of cutting a film into slices to be used as artificial turf fibers destroys polymer crystals whose formation was caused by the nucleating agent in the stretching step. Thus, artificial turf fibers which are created by slicing an extruded and stretched polymer film will have a lower surface roughness than monofilaments which were stretched in a stretching operation.

In a further aspect, the invention relates to the manufacturing artificial turf such that an artificial turf fiber of the artificial turf remains fixed in an artificial turf backing upon applying a predefined pulling force, the method comprising the steps of:

creating a polymer mixture comprising at least one polymer, a determined amount of a nucleating agent, and optionally one or more dyes;

wherein the nucleating agent is an inorganic and/or an organic substance or a mixture thereof; for example, the nucleating agent can be one or more of the above mentioned substances;

wherein the determined amount of the nucleating agent is the minimum amount of said nucleating agent necessary for providing a monofilament which is—after its extrusion, stretching and incorporation into an artificial turf backing in the form of an artificial turf fiber—capable of resisting the predefined pulling force;

wherein the determined amount of nucleating agent depends on the number and type of dyes contained in the polymer mixture, if any, and depends on the capability of each of said dyes to act as a nucleating agent;

extruding the polymer mixture into a monofilament;

quenching the monofilament;

reheating the monofilament;

stretching the reheated monofilament to form the monofilament into the artificial turf fiber;

incorporating the artificial turf fiber into the artificial turf backing by:

arranging a plurality of the artificial turf fibers on a carrier, wherein first parts of the monofilaments of the arranged artificial turf fibers are exposed to a bottom side of the carrier and second parts of said monofilaments are exposed to a top side of the carrier;

adding a fluid on the bottom side of the carrier such that at least the first parts become embedded in the fluid; and causing the fluid to solidify into a film, the film surrounding and thereby mechanically fixing at least the first parts of the monofilaments of the arranged artificial turf fibers, the solid film acting as the artificial turf backing.

Said features may be beneficial as they allow the creation of artificial turf whose surface roughness and corresponding ability to resist tuft withdrawal forces can be controlled and can be set to a desired value for a variety of different polymer mixtures, in particular for a large variety of polymer mixtures comprising different pigments and other dyes. According to a surprising observation, artificial turf fibers of a particular color were observed to show a higher resistance to tuft withdrawal forces than fibers having a different color. According to a further surprising observation, the increased resistance of fibers of some colors to tuft withdrawal forces is caused by nucleating capabilities of the respective dye, the dye having an impact on the number and size of crystalline portions and on the flexibility of an artificial turf fiber. Determining the amount of nucleating agent in dependence on the kind and amount of the dyes of the polymer mixture allow mixing turf fibers comprising different kinds of dyes in the same piece of artificial turf, whereby all turf fibers are manufactured such that they show the same resistance to tuft withdrawal forces and thus are equally resistant to wear and tear during the whole lifetime of the artificial turf. Thus, the lifetime of a piece of turf is not limited any more by the turf fiber comprising the pigment with the lowest capability of acting as a nucleating agent: according to embodiments, in case the one or more dyes in the polymer mixture are not able to trigger crystallization to a sufficient degree, an appropriate amount of nucleating agent may be added. Also, in case a polymer mixture already comprises a dye with sufficient nucleating capabilities, the amount of nucleating agent added to the polymer mixture may be reduced or may even be zero, thereby avoiding that the amount of polymer crystals exceeds the amount necessary for achieving the desired resistance to a tuft withdrawal force, also referred herein as "pulling force". This may reduce costs and may reduce the total amount of inorganic material in the fiber (a high fraction of inorganic material may reduce the flexibility of the fiber).

According to embodiments, the amount of nucleating agent is determined by performing a series of tests: a polymer mixture, referred herein as "desired polymer mixture", is created. The "desired polymer mixture" comprises all components of the polymer mixture to be used for creating the artificial turf fiber but does not yet comprise the nucleating agent whose amount shall be determined. Thus, said "desired polymer mixture" comprises the at least one polymer, zero, one or more dyes and zero, one or more additional additives. The "desired polymer mixture", is extruded, stretched and incorporated into a turf backing as described. Preferentially, only a small amount of the "desired polymer mixture" is created and only a small piece of artificial turf is manufactured and used as a sample for testing. The predefined pulling force ("tuft withdrawal force") is then applied on an artificial turf fiber, e.g. in accordance with ISO/DES 4919:2011. If the artificial turf fiber remains fixed in the turf backing, adding of additional nucleating agents such as, for example, talcum or kaolin, can be omitted and the determined amount of the nucleating agent is zero. In case the artificial turf fiber is withdrawn by the determined pulling force, several additional polymer mixtures comprising the same composition of polymer, dyes and optional further additives as the "desired polymer mixture" are created. To each of said additional polymer mixtures, a growing amount of nucleating agent is added. For example, to additional polymer mixture APM1, 0.5% by weight of the polymer mixture is added. To additional polymer mixture APM2, 1% by weight of the polymer mixture is added. To additional polymer mixture APM3, 1.5% by weight of the polymer mixture is added. And so on, e.g. up to an amount of 3% by weight of the polymer mixture for inorganic nucleating agents or up to higher amounts, e.g. 8%, for organic nucleating agents. Each of said additional polymer mixtures is extruded, stretched and incorporated into the backing of a respective piece of artificial turf as described above. The one of the additional polymer mixtures comprising the minimum amount of nucleating agent that is sufficient for providing an artificial turf fiber that is not withdrawn from the artificial turf backing upon applying the determined pulling force is used as the determined amount of the nucleating agent. The determined amount of the nucleating agent is then added to the desired polymer mixture for manufacturing the artificial turf having the desired resistance to the predefined pulling force on a larger scale.

The features of the following embodiments can be combined with any one of the above methods for manufacturing artificial turf and with any kind of artificial turf disclosed herein if the features are not mutually exclusive.

According to preferred embodiments, the nucleating agent boosts, during the stretching, the creation of crystalline portions of the at least one polymer within the monofilament, wherein the boosting of the creation of the crystalline portions increases the surface roughness of the monofilament. Thus, also the surface of the monofilament will comprise polymer crystals which are created after the extrusion process and thus cannot be destroyed by mechanical forces acting on the polymer mixture during the extrusion process.

According to preferred embodiments, talcum and/or china clay is used. Preferably the talcum is used.

According to embodiments, if inorganic nucleating agents are used, the particle size of the nucleating agent is between 0.1 nanometer-50 micrometer, preferably between 0.1 nanometer-10 micrometer and still preferably 10 nanometer-5 micrometer.

According to some embodiments wherein an inorganic nucleating agent such as talcum is used as nucleating agent, 0.01-3 percentage by weight of the polymer mixture consists of the inorganic substance that is added to the polymer mixture for acting as the nucleating agent; Preferentially, 0.05-1 percentage by weight of the polymer mixture consists of said inorganic nucleating agent. Even more preferably 0.2-0.4 percentage by weight of the polymer mixture consists of said nucleating agent. Each part or fraction of the added inorganic substance may act the nucleating agent. Alternatively, at least fractions thereof act as the nucleating agent.

According to embodiments, at least a fraction of the total amount of the substance added for actually acting as the nucleating agent has a particle size smaller than 50 micrometer, preferably smaller than 10 micrometer and still preferably smaller than 5 micrometer.

The substance added for acting as the nucleating agent to the polymer mixture may be, for example, talcum.

According to some embodiments, the fraction of the inorganic nucleating agent that actually acts as the nucleating agent comprises at least 20% by weight of the talcum, more preferentially said fraction comprises at least 70% by weight of the talcum and more preferentially said fraction comprises at least 90% by weight of the talcum. Thus, for example, at least 20% of the talcum added to the polymer mixture must be smaller than 50 micrometer, preferably smaller than 10 micrometer and still preferably smaller than 5 micrometer.

According to embodiments, the at least one polymer comprises crystalline portions and amorphous portions, wherein the presence of the nucleating agent in the polymer mixture during the stretching causes an increase in the size of the crystalline portions relative to the amorphous portions. This may lead for instance to the at least one polymer to become more rigid than when it has an amorphous structure. This may lead to an artificial turf with more rigidity and ability to spring back when pressed down. The stretching of the monofilament may cause the at least one polymer to have a larger portion of its structure become more crystalline. Stretching the at least one polymer will cause an even further increase in the crystalline regions in the presence of a nucleating agent.

According to embodiments, the polymer mixture comprises less than 20 percentage by weight of inorganic material in total, wherein the inorganic material may comprise inorganic fractions of the chemically inert filler material and/or inorganic dyes (e.g. $TiO_2$) and/or the inorganic nucleating agent. Preferentially, the polymer mixture comprises less than 15 percentage by weight of said inorganic material in total. Even more preferentially, the polymer mixture comprises less than 105 percentage by weight of said inorganic material in total.

This may be advantageous as it is ensured that the tensile strength of the turf filament created from the polymer mixture is not significantly decreased by a growing fraction of crystalline portions in the filament.

According to embodiments, the fluid added on the bottom side of the carrier is a suspension comprising at least 20 percent by weight styrene-butadiene, at least 40% of chemically inert filler material, and at least 15% dispersion fluid. The solidification of the fluid into the film comprises drying the suspension, e.g. by applying heat and/or air flow. Said film consisting of a solidified styrene-butadiene suspension is also known as latex film.

According to embodiments, the suspension comprises 22-28 percent by weight of the styrene-butadiene, 50-55 percent by weight of the filler material, and at least 20% of water acting as the dispersion fluid. The suspension may also comprises 24-26% by weight styrene-butadiene.

According to other embodiments, the fluid is a mixture of polyols and polyisocyanates. Polyols, as used herein, are compounds with multiple hydroxyl functional groups available for organic reactions. The solidification of the fluid into the film comprises executing a polyaddition-reaction of the polyols and the polyisocyanates for generating polyurethane. The solid film is a polyurethane film.

According to embodiments, the fluid comprises one or more of the following compounds: antimicrobial additives, fungicides, odor-emitting substances, a UV stabilizer, a flame retardant, an anti-oxidant, a pigment.

In some examples the stretched monofilament may be used directly as the artificial turf fiber. For example the monofilament could be extruded as a tape or other shape. In other examples the artificial turf fiber may be a bundle or group of several stretched monofilament fibers is in general cabled, twisted, or bundled together. The method may further comprise weaving, bundling, or spinning multiple monofilaments together to create the artificial turf fiber. Multiple, for example 4 to 8 monofilaments, could be formed or finished into a yarn. In some cases the bundle is rewound with a so called rewinding yarn, which keeps the yarn bundle together and makes it ready for the later tufting or weaving process. The monofilaments may for instance have a diameter of 50-600 micrometer in size. The yarn weight may typically reach 50-3000 dtex.

In another embodiment creating the artificial turf fiber comprises weaving the monofilament into the artificial turf fiber. That is to say in some examples the artificial turf fiber is not a single monofilament but a combination of a number of fibers. In another embodiment the artificial turf fiber is a yarn. In another embodiment the method further comprises bundling stretched monofilaments together to create the artificial turf fiber.

According to embodiments the method further comprises determining an amount of the nucleating agent such that said amount of the nucleating agent is capable of boosting the creation of crystalline portions such that the crystallization is slow enough to ensure that the majority of crystalline portions is created during the stretching (and thus, not before the stretching) and is sufficient to boost the creation of sufficiently many crystalline portions to ensure that the surface roughness is high enough that the embedded artificial turf fiber remains fixed in the artificial turf backing unless a pulling force over 30 Newton, more preferentially over 40 Newton, more preferentially over 50 Newton, is applied on the fiber. The adding of the nucleating agent comprises adding the determined amount of the nucleating agent.

According to embodiments, the determination if the embedded artificial turf fiber remains fixed in the artificial turf backing unless a pulling force over one of the above specified thresholds is applied on the fiber is executed in accordance with a test for measuring a tuft withdrawal force as specified in ISO/DES 4919:2011.

According to embodiments, a substance being capable of acting as a nucleating agent is a substance that, if added to the polymer mixture, is capable of increasing the frictional forces which fix the artificial turf fiber in the artificial turf backing by at least 10 Newton in accordance with a test for measuring a tuft withdrawal force as specified in ISO/DES 4919:2011. Preferentially, this effect is achieved without significantly increasing the brittleness of the material of the artificial turf fiber to be created from the polymer mixture. Preferentially, a substance being capable of acting as a nucleating agent is a substance that, if added to the polymer mixture in an amount that less than 3 percentage by weight of the polymer mixture consists of the added nucleating agent, is capable of increasing the frictional forces which fix the artificial turf fiber in the artificial turf backing by 10 Newton in accordance with a test for measuring a tuft withdrawal force as specified in ISO/DES 4919:2011.

According to embodiments, a substance being capable of acting as a dye is a substance that causes the artificial turf fiber to be created from the polymer mixture to emit a predefined spectrum of visible light. For example, a spectrophotometer and/or a colorimeter may be used to test if the dye causes the generated fiber to emit a predefined spectral pattern, e.g. a spectral pattern that is perceived by the human eye as "green", "white", "blue" or any other color. The color may be specified by means of the CMYK color code, the RAL color code, the Pantone color code or any other standard to test if a measured emission spectrum reflects a desired spectral pattern.

According to embodiments, the predefined spectrum of visible light caused by the dye differs from the spectrum of visible light emitted from the same type of artificial turf fiber lacking said dye.

According to embodiments, the artificial turf apparatus my be further configured to:

add first amount of a first dye to the polymer mixture, the first amount of the first dye being incapable of boosting the creation of the crystalline portions; the first amount of the first dye may be completely incapable of boosting the creation of any polymer crystal or may be incapable of boosting the creation of a predefined, desired amount of crystalline portions in the extruded and stretched monofilament; the first dye may be capable of boosting the creation of the crystalline portions if added to the polymer mixture in a higher concentration, but not in the given, first amount, which cannot be changed or increased as this would have an impact on the color of the fibers; the color of the artificial turf to be manufactured is, however, considered as given and should not be changed;

determine second amount of the nucleating agent, wherein the second amount is determined such that the first amount of the first dye in combination with the second amount of the nucleating agent are capable of boosting the creation of crystalline portions such that the crystallization is slow enough to ensure that the majority of crystalline portions is created during the stretching and is sufficient to boost the creation of sufficiently many crystalline portions to ensure that the surface roughness is high enough that a bundle of six embedded artificial turf fibers remains fixed in the artificial turf backing unless a pulling force over 30 Newton more preferentially over 40 Newton, more preferentially over 50 Newton, is applied on the fiber. The adding of the nucleating agent comprises adding the determined second amount of the nucleating agent.

Said features may be advantageous as they allow reducing the amount of nucleating agent in case the used dye already has some (measurable but insufficient) capability to boost the crystallization of the at least one polymer. Also, in case two dyes of the same color are available, the method may comprise choosing the one out of said two dyes having the higher capability to act as nucleating agent and to boost the crystallization of the at least one polymer. This may also improve the fixing of the fibers into the backing and may help to reduce the amount of nucleating agent necessary.

Choosing the amount and type of the nucleating agent such that the majority of crystals is formed in the stretching process (rather than in the extrusion process) may be advantageous as this crystals which are created before or during the extrusion process may be destroyed by the shear forces that are generated at the surface of a nascent monofilament when the polymer mixture is pressed through said openings. Thus, the surface roughness achieved by a given amount of nucleating agent can be maximized.

According to embodiments, the total amount of inorganic material in the polymer mixture is below 20% by weight, more preferentially below 15% by weight and even more preferentially below 10% by weight. Minimizing the amount of nucleating agent, in particular minimizing the amount of inorganic nucleating agent, may allow achieving a desired degree of surface roughness and resistance to the pulling force without the fibers becoming become brittle due to an interruption of Van-der-Waals forces between the polymers by the inorganic material and/or by a too large number of crystalline portions.

In a further advantageous aspect, using a dye that is also capable of acting as nucleating agent may allow to ensure that the total amount of inorganic material in the polymer mixture is below 20% by weight, more preferentially below 15% by weight and even more preferentially below 10% by weight. This will ensure that the fiber does not become brittle if the Van-der-Waals forces between the polymers are weakened by the inorganic material and/or by a too large number of crystalline portions.

According to embodiments the method further comprises adding Titanium-Dioxide to the polymer mixture. Titanium-Dioxide may allow to create lighter fiber colors or fibers having a white tone. The Titanium-Dioxide acts as a dye. The polymer mixture comprises 1,9-2,3 (preferably 2,1) percentage by weight of the Titanium-Dioxide after said adding.

According to embodiments the method further comprises adding an azo-nickel-complex pigment to the polymer mixture. The azo-nickel-complex pigment acts as a dye. The polymer mixture comprises 0.01-0.5 (preferably between 0.1-0.3) percentage by weight of the azo-nickel-complex pigment after said adding.

According to embodiments phthalocyanine metal complexes like e.g. phthalocyanine copper complexes may be used as substances acting as a dye and as a nucleating agent.

According to first group of embodiments the method further comprises adding phthalocyanine green to the polymer mixture. The phthalocyanine green acts as a dye. The polymer mixture comprises 0.001-0.3 (preferably 0.05-0.2) percentage by weight of the phthalocyanine green after said adding.

According to a second group of embodiments the method further comprises adding phthalocyanine blue to the polymer mixture. phthalocyanine blue acts as a dye. The polymer mixture comprises 0.001-0.25 (preferably 0.15-0.20) percentage by weight after said adding.

The method of any one of the previous claims, wherein some or all parts of the surface of the artificial turf fiber embedded in the fluid are wetted by the fluid. According to embodiments the at least one polymer is a non-polar polymer.

Applying the above described method on non-polar polymers is particularly advantageous as non-polar polymers tend to be hydrophobic. This is known to impede the wettening by hydrophilic fluids such as the above mentioned suspension for creating a latex film. It has been observed that the adding of the nucleating agent results in an increased surface roughness of the filament due to an increased fraction of crystalline portions within the filament and also results in an increased wettening of the fiber surface by the applied fluid used for embedding at least the first parts of the fibers. The increased surface roughness of the fiber provides for a synergistic effect with the increased wettening effect: the eased wettening of the fiber surface allows the fluid to penetrate also tight, deep depressions and recesses of the surface of the fiber. This results in a strong mechanical fixing of the fiber in the solidified fluid.

According to embodiments the at least one polymer is polyethylene, polypropylene, or a mixture thereof. Preferentially, the at least one polymer is polyethylene. The kind of olefin used for creating the artificial turf fiber has a significant impact on various properties of the fiber and the artificial turf made from said fiber. Polyamides (PA), for example, are known for their good bend recovery. However, their surface is known to cause skin burns when used as ground of a sports field, and the life expectancy of a PA-based artificial turf is limited if extensively exposed to UV radiation of direct sunlight. Polypropylene has similar disadvantages. Polyethylene (PE) does not show said disadvantages but has the disadvantage that it cannot be fixed firmly to a backing by mechanical forces due to its hydrophobic surface and increased softness compared to PA/PP. Thus, embodiments of the invention may allow using PE for manufacturing the artificial turf and may allow to firmly and mechanically attach PE fibers to the artificial turf backing.

According to embodiments the polymer mixture comprises 80 to 90 percent by weight the at least one polymer.

According to embodiments, creating the artificial turf fiber comprises forming the stretched monofilament into a yarn.

According to embodiments, creating the artificial turf fiber comprises weaving, spinning, twisting, rewinding, and/or bundling the stretched monofilament into the artificial turf fiber.

According to embodiments, incorporating the artificial turf fiber into the artificial turf backing comprises: tufting the artificial turf fiber into the artificial turf backing and binding the artificial turf fibers to the artificial turf backing. For instance the artificial turf fiber may be inserted with a needle into the backing and tufted the way a carpet may be. If loops of the artificial turf fiber are formed then the loops may be cut during the same step.

According to embodiments, incorporating the artificial turf fiber into the artificial turf backing comprises weaving the artificial turf fiber into the artificial turf backing. This technique of manufacturing artificial turf is known from United States patent application US 20120125474 A1. By using a weaving technique, it is possible to obtain a semi-random pattern in the carrier which may give the artificial turf a natural appearance. Furthermore, weaving is a simpler technique than tufting as the cutting of the fibers after their insertion into the carrier is omitted. In tufting, the fiber is woven into the carrier first, and subsequently loops the fibers at one side of the carrier are cut. After having woven the fiber into the carrier, the fluid is applied on the bottom side of the carrier as described above.

According to embodiments the carrier is a textile or a textile matt. A textile may be a flexible woven material consisting of a network of natural or artificial fibers often referred to as thread or yarn. Textiles are formed by weaving, knitting, crocheting, knotting, or pressing fibers together.

In another embodiment the polymer mixture further comprises any one of the following: a wax, a dulling agent, a ultraviolet stabilizer, a flame retardant, an anti-oxidant, a pigment, and combinations thereof. These listed additional components may be added to the polymer mixture to give the artificial turf fibers other desired properties such as being flame retardant, having a green color so that the artificial turf more closely resembles grass and greater stability in sunlight.

The melt temperature used during extrusions is dependent upon the type of polymers and compatibilizer that is used. However the melt temperature is typically between 230° C. and 280° C.

A monofilament, which can also be referred to as a filament or fibrillated tape, is produced by feeding the mixture into an fiber producing extrusion line. The melt mixture is passing the extrusion tool, i.e., a spinneret plate or a wide slot nozzle, forming the melt flow into a filament or tape form, is quenched or cooled in a water spin bath, dried and stretched by passing rotating heated godets with different rotational speed and/or a heating oven.

The monofilament or type is then annealed online in a second step passing a further heating oven and/or set of heated godets.

According to embodiments, the polymer mixture is at least a three-phase system. The polymer mixture comprises a first polymer and the at least one polymer referred to in the following as 'second polymer'. The first polymer and the second polymer are immiscible.

The first polymer may consist of, for example, a polar substance, such as polyamide. The first polymer could also be polyethylene terephthalate which is commonly known by the abbreviation PET.

The second polymer can be a non-polar polymer, such as polyethylene. In another embodiment the second polymer is polybutylene terephthalate which is also known by the common abbreviation PBT or polypropylene (PP).

The polymer mixture may further comprise a compatibilizer. The compatibilizer may be any one of the following: a maleic acid grafted on polyethylene or polyamide; a maleic anhydride grafted on free radical initiated graft copolymer of polyethylene, SEBS, EVA, EPD, or polyproplene with an unsaturated acid or its anhydride such as maleic acid, glycidyl methacrylate, ricinoloxazoline maleinate; a graft copolymer of SEBS with glycidyl methacrylate, a graft copolymer of EVA with mercaptoacetic acid and maleic anhydride; a graft copolymer of EPDM with maleic anhydride; a graft copolymer of polypropylene with maleic anhydride; a polyolefin-graft-polyamidepolyethylene or polyamide; and a polyacrylic acid type compatibilizer.

The first polymer forms polymer beads surrounded by the compatibilizer within the second polymer. The term 'polymer bead' or 'beads' may refer to a localized region, such as a droplet, of a polymer that is immiscible in the second polymer. The polymer beads may in some instances be round or spherical or oval-shaped, but they may also be irregularly-shaped. In some instances the polymer bead will typically have a size of approximately 0.1 to 3 micrometer, preferably 1 to 2 micrometer in diameter. In other examples the polymer beads will be larger. They may for instance have a size with a diameter of a maximum of 50 micrometer.

The adding of the first dye or of the substance is executed before the extruding. The stretching results in a deformation of the polymer beads into threadlike regions. This causes the monofilament to become longer and in the process the polymer beads are stretched and elongated. Depending upon the amount of stretching the polymer beads are elongated more.

The thread-like regions may have a diameter of less than 20 micrometer, e.g. less than 10 micrometer. In another embodiment the thread-like regions have a diameter of between 1 and 3 micrometer. In another embodiment the artificial turf fiber extends a predetermined length beyond the artificial turf backing. The thread-like regions have a length less than one half of the predetermined length, e.g. a length of less than 2 mm.

Embodiments may have the advantage that the second polymer and any immiscible polymers may not delaminate from each other. The thread-like regions are embedded within the second polymer. It is therefore impossible for them to delaminate. The use of the first polymer and the second polymer enables the properties of the artificial turf fiber to be tailored. For instance a softer plastic may be used for the second polymer to give the artificial turf a more natural grass-like and softer feel. A more rigid plastic may be used for the first polymer or other immiscible polymers to give the artificial turf more resilience and stability and the ability to spring back after being stepped or pressed down. A further advantage may possibly be that the thread-like regions are concentrated in a central region of the monofilament during the extrusion process. This leads to a concentration of the more rigid material in the center of the monofilament and a larger amount of softer plastic on the exterior or outer region of the monofilament. This may further lead to an artificial turf fiber with more grass-like properties. A further advantage may be that the artificial turf fibers have improved long term elasticity. This may require reduced maintenance of the artificial turf and require less brushing of the fibers because they more naturally regain their shape and stand up after use or being trampled.

In another embodiment the polymer mixture comprises between 5% and 10% by weight of the first polymer. This example may have the balance of the weight made up by the second polymer, the compatibilizer, and any other additional additives mixed into the polymer mixture.

In another embodiment the creating of the polymer mixture comprises the step of forming a first mixture by mixing the first polymer with the compatibilizer. The creation of the polymer mixture further comprises the step of heating the first mixture. The step of creating the polymer mixture further comprises the step of extruding the first mixture. The creation of the polymer mixture further comprises the steps of granulating the extruded first mixture. The creating of the polymer mixture further comprises the step of mixing the granulated first mixture with the second polymer, the nucleating agent and optionally additives and/or dyes. The creation of the polymer mixture further comprises the step of heating the granulated first mixture with the second polymer to form the polymer mixture. This particular method of creating the polymer mixture may be advantageous because it enables very precise control over how the first polymer and compatibilizer are distributed within the second polymer. For instance the size or shape of the extruded first mixture may determine the size of the polymer beads in the polymer mixture. In the aforementioned method of creating the polymer mixture for instance a so called one-screw extrusion method may be used.

As an alternative to this the polymer mixture may also be created by putting all of the components that make it up together at once. For instance the first polymer, the second polymer, the nucleating agent and the compatibilizer could be all added together at the same time. Other ingredients such as additional polymers or other additives and dyes could also be put together at the same time. The amount of mixing of the polymer mixture could then be increased for instance by using a two-screw feed for the extrusion. In this case the desired distribution of the polymer beads can be achieved by using the proper rate or amount of mixing.

In a first step, the first polymer may be mixed with the compatibilizer. Color pigments, UV and thermal stabilizers, process aids and other substances that are as such known from the art can be added to the mixture. This may result in granular material which consist of a two phase system in which the first polymer is surrounded by the compatibilizer. In a second step, a three-phase system is formed by adding the second polymer to the mixture whereby in this example the quantity of the second polymer is about 80-90 mass percent of the three-phase system, the quantities of the first polymer being 5% to 10% by mass and of the compatibilizer being 5% to 10% by mass. Using extrusion technology results in a mixture of droplets or of beads of the first polymer surrounded by the compatibilizer that is dispersed in the polymer matrix of the second polymer. In a practical implementation a so called master batch including granulate of the first polymer and the compatibilizer is formed. The master batch may also be referred to as a "polymer mixture" herein. The granulate mix is melted and a mixture of the first polymer and the compatibilizer is formed by extrusion. The resulting strands are crushed into granulate. The resultant granulate and granulate of the second polymer are then used in a second extrusion to produce the thick fiber which is then stretched into the final fiber.

The extrusion is executed as described above. By this procedure the beads or droplets of polymer 1, surrounded by the compatibilizer are stretched into longitudinal direction and form small fiber like, linear structures which stay however completely embedded into the polymer matrix of the second polymer.

According to some embodiments of the further method of manufacturing artificial turf, the predetermined pulling force is 30 Newton, more preferentially 40 Newton, more preferentially 50 Newton.

According to some embodiments of the further method of manufacturing artificial turf, the determined amount of the nucleating agent is determined such that said amount of the nucleating agent is capable of boosting the creation of crystalline portions such that the crystallization is slow enough to ensure that the majority of crystalline portions is created during the stretching and is sufficient to boost the creation of sufficiently many crystalline portions to ensure that the surface roughness is high enough that the embedded artificial turf fiber remains fixed in the artificial turf backing unless the predefined pulling force is applied.

For example, this may be determined by executing a series of tests as described above.

According to embodiments, the polymer mixture comprises 1.9-2.3 percentage by weight Titanium-Dioxide, the Titanium-Dioxide acting as a dye. Alternatively, the polymer mixture comprises 0.01-0.5 percentage by weight an azo-nickel-complex pigment, the azo-nickel-complex pigment acting as a dye. In each of said two cases, the determined amount of the nucleating agent for said polymer mixture is identical to an amount of the nucleating agent determined for polymer mixtures not comprising any dye. The amount of nucleating agent necessary depends on the determined pulling force and the type of nucleating agent used. For example, the nucleating agent is an inorganic substance, and the determined amount of the nucleating agent is 0.01-3 percentage by weight of the polymer mixture. For example, the determined pulling force may be 30 Newton, more preferentially 40 Newton, more preferentially 50 Newton and a fiber created from said polymer mixture will be capable of resisting any of said pulling forces.

According to other embodiments, the polymer mixture comprises 0.001-0.3 percentage by weight of phthalocyanine green, the phthalocyanine green acting as a dye. Alternatively, the polymer mixture comprises 0.001-0.25 percentage by weight of phthalocyanine blue, the phthalocyanine blue acting as a dye. In each of said two cases, the determined amount of the nucleating agent for said polymer mixture is zero. For example, the determined pulling force may be 30 Newton, more preferentially 40 Newton, more preferentially 50 Newton and a fiber created from said polymer mixture will be capable of resisting any of said pulling forces. No additional nucleating agent may be necessary as phthalocyanine green and phthalocyanine blue are capable of acting as a nucleating agent.

According to some embodiments of the further method of manufacturing artificial turf, the method comprises creating a first artificial turf fiber from the above mentioned polymer mixture comprising the Titanium-Dioxide or the azo-nickel-complex pigment. The method further comprises creating a second artificial turf fiber from the above mentioned polymer mixture comprising the phthalocyanine green or phthalocyanine blue dye. Both the first and the second artificial turf fiber are incorporated in the same piece of artificial turf. This may be beneficial as e.g. white fibers comprising Titanium-Dioxide show the same resistance against the determined pulling force as green fibers (comprising phthalocyanine blue dye).

In a further aspect, the invention relates to an artificial turf manufactured according to the method of any one of the above mentioned embodiments.

In a further aspect, the invention relates to an artificial turf comprising an artificial turf backing and artificial turf fiber incorporated into the artificial turf backing. The artificial turf fiber comprises at least one monofilament. Each of the at least one monofilament comprises at least one polymer and a nucleating agent for crystallizing the at least one polymer. The nucleating agent is one of the organic or inorganic substances mentioned above.

The artificial turf fiber and a plurality of further artificial turf fibers are arranged together in a carrier. The carrier lies on a surface of or within the artificial turf backing. The fibers are arranged in a way that first parts of the monofilaments of the arranged artificial turf fibers are exposed to a bottom side of the carrier and second parts of said monofilaments are exposed to a top side of the carrier. At least the first parts are embedded in and mechanically fixed by a solid film. The solid film is a solidified fluid. The solid film acts as the artificial turf backing.

In a further aspect the invention relates to an artificial turf comprising an artificial turf backing and an artificial turf fiber incorporated into the artificial turf backing. The artificial turf fiber comprises at least one monofilament.

Each of the at least one monofilament comprises: at least one polymer; a first substance incapable of acting as a dye and capable of acting as a nucleating agent for crystallizing the at least one polymer; and a second substance capable of acting as a dye and incapable of acting as a nucleating agent for crystallizing the at least one polymer.

A plurality of the artificial turf fibers are arranged in a carrier in a way that first parts of the monofilaments of the arranged artificial turf fibers are exposed to a bottom side of the carrier and second parts of said monofilaments are exposed to a top side of the carrier. At least the first parts are embedded in and mechanically fixed by a solid film. The solid film is a solidified fluid. The solid film acts as the artificial turf backing.

According to embodiments, the artificial turf backing further incorporates a further artificial turf fiber. The further artificial turf fiber comprises at least a further monofilament. The further monofilament comprises at least one further polymer and a third substance. The at least one further polymer is chemically identical to the above mentioned at least one polymer or is chemically different from the above mentioned at least one polymer (e.g. PP instead of PE, or a PE variant having different kind of side group or side groups). The third substance is capable of acting as a nucleating agent for crystallizing the at least one further polymer and is in addition capable of acting as a dye. A plurality of the further artificial turf fibers are also arranged in the carrier in a way that first parts of the further monofilaments of the arranged further artificial turf fibers are exposed to the bottom side of the carrier and second parts of said further monofilaments are exposed to the top side of the carrier. At least the first parts of said further monofilaments also are embedded in and mechanically fixed by the solid film.

According to embodiments, the further monofilament lacks the first substance and lacks any further nucleating agent. Thus, the third substance may be the only nucleating agent contained in the further monofilament. This may be advantageous, because in case a desired tuft withdrawal force is achieved by the nucleating capabilities of a used dye alone, adding additional nucleating agents might reduce the flexibility of the fiber by an increased amount of crystalline polymer portions.

According to embodiments, the type and amount of the second substance is chosen such that the resistance of the at least one monofilament to a predefined tuft withdrawal force is identical to the resistance of the further monofilament to said predefined tuft withdrawal force. The resistance of a monofilament to an applied tuft withdrawal force can be determined, for example, with the above mentioned test for measuring a tuft withdrawal force specified in ISO/DES 4919:2011. This may allow manufacturing an artificial turf comprising a mixture of fibers of different colors which—despite different nucleating capabilities of the respective dyes—all have the same surface roughness and show the same resistance to a given tuft withdrawal force.

According to embodiments, the at least one monofilament and also the further monofilament have been created by the extrusion and stretching process as described above.

According to embodiments, the third substance is phthalocyanine green or phthalocyanine blue or a mixture thereof.

According to embodiments, the first substance is Titanium-Dioxide or azo nickel-complex pigment or a mixture thereof.

According to embodiments, the second substance is one of the above mentioned organic and/or inorganic nucleating agents such as sorbic acid or talcum.

According to embodiments, the first substance is Titanium-Dioxide which may be used as a dye providing white color. The plurality of the artificial turf fibers comprising the first substance are positioned within the artificial turf backing such that one or more continuous lines solely comprising artificial turf fibers comprising the first substance are formed. Each of said lines has a width of at least 1 centimeter and a length of at least 1 meter. Each of said lines are surrounded by areas of the artificial turf which selectively comprise other artificial turf fibers. The other artificial turf fibers comprise a different dye or no dye at all. Said features may be advantageous as an artificial turf is provided that comprises white lines which may be used as floor of a sports field. The white fibers are mechanically fixed to the turf backing as strongly as the green turf fibers, as the white fibers comprise a separate nucleating agent in addition to the dye. White fibers previously were observed to detach earlier than green fibers from the backing. By combining the green fibers with white fibers that have been stretched in the presence of a nucleating agent, an artificial turf is provided whose white fibers are fixed to the backing as strongly as the green fibers.

According to embodiments, each artificial turf fiber incorporated in the artificial turf backing is created by a process comprising: extruding the polymer mixture into a monofilament; quenching the monofilament; reheating the monofilament; and stretching the reheated monofilament to form the monofilament into an artificial turf fiber. In case the polymer mixture comprises a nucleating agent and/or a dye acting as nucleating agent, during the stretching the nucleating agent boosts the creation of crystalline portions of the at least one polymer within the monofilament, wherein the boosting of the creation of the crystalline portions increases the surface roughness of the monofilament.

According to embodiments, each of the at least one monofilament comprises a first polymer in the form of threadlike regions and the at least one polymer referred herein as a "second polymer". The threadlike regions are embedded in the second polymer. The first polymer is immiscible in the second polymer. The polymer mixture further comprises a compatibilizer surrounding each of the threadlike regions and separating the at least one first polymer from the second polymer.

It is understood that one or more of the aforementioned embodiments of the invention may be combined as long as the combined embodiments are not mutually exclusive.

BRIEF DESCRIPTION OF THE DRAWINGS

In the following embodiments of the invention are explained in greater detail, by way of example only, making reference to the drawings in which.

DETAILED DESCRIPTION

Figure 1:
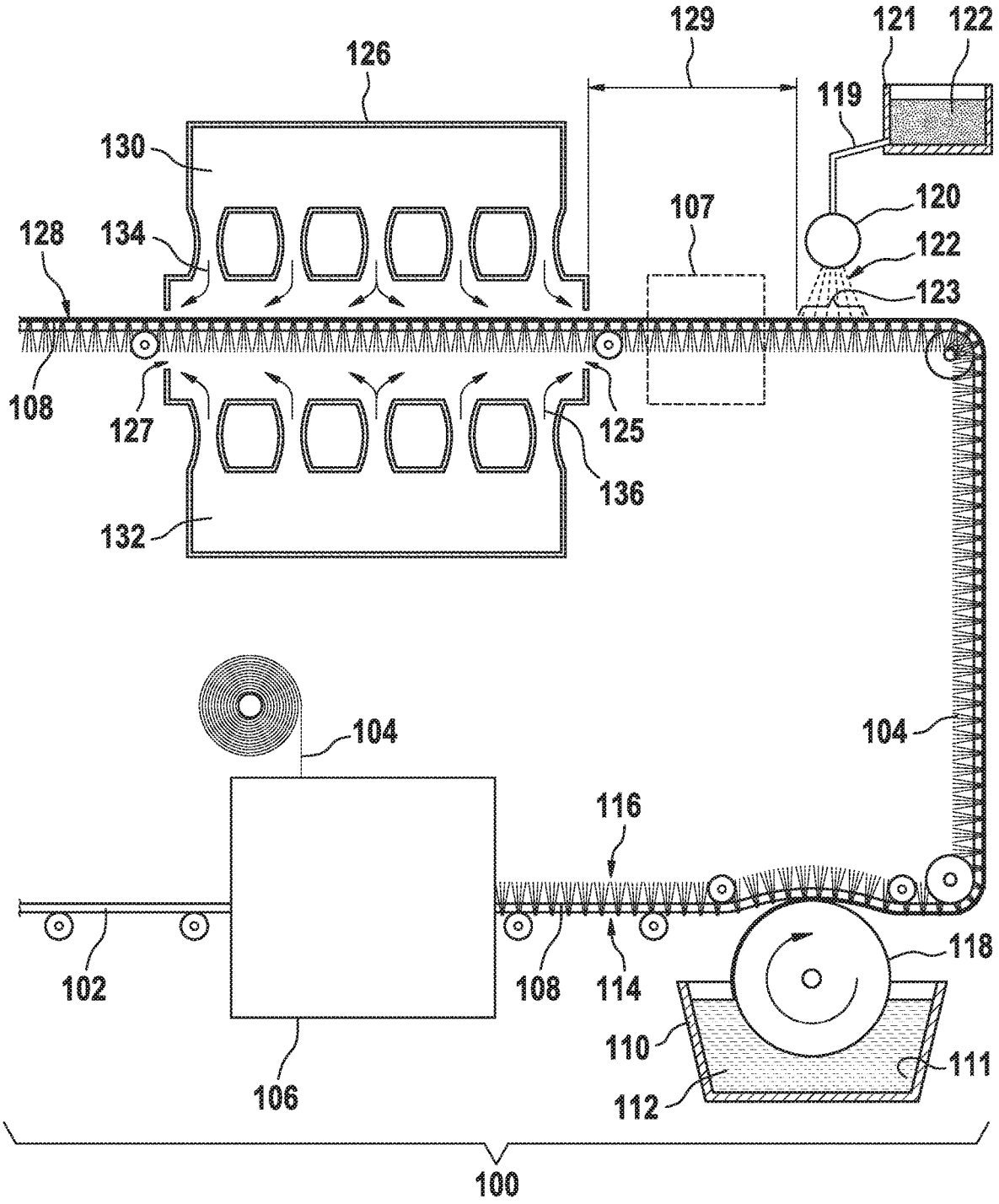
FIG. 1 illustrates an example of a machine for making artificial turf.
Figure 2:
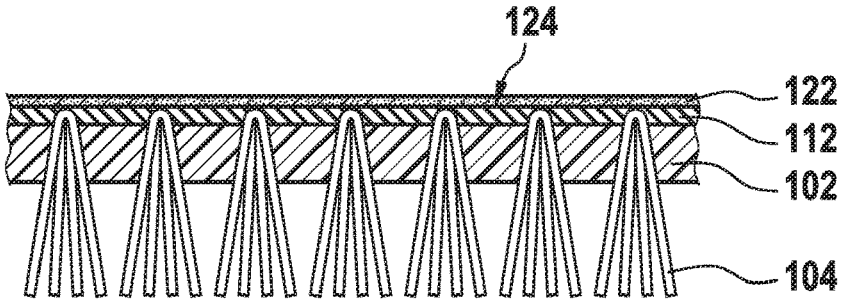
FIG. 2 shows an enlarged view of a portion of FIG. 2.

FIG. 1 shows an example of a machine 100 for manufacturing artificial turf. The artificial turf is labeled 108. The machine 100 can be seen as taking artificial turf backing 102 and artificial turf fiber 104 as input. A fiber inserter 106 then inserts the artificial turf fiber 104 into the artificial turf backing 102. artificial turf 108 can be seen as exiting the fiber inserter 106. The dashed box 107 is FIG. 2 shows a portion the artificial turf 108 that is shown in greater detail in FIG. 2. The artificial turf 108 then runs through a coater 110. The coater 110 spreads colloidal latex 112 onto an underside of the artificial turf backing. The artificial turf fibers extend out from an artificial turf surface 116. In the example illustrated a lick roll with a rotating element 118 is used to apply the colloidal latex 112 to the underside 114. This is however not the only means of applying the colloidal latex. The colloidal latex coating could for example be dispensed on the surface of the underside and then be leveled using the knife over roll method. The machine may also comprise a colloidal latex coating reservoir 111 that stores the colloidal latex coating and provides the colloidal latex coating to the coater. In some examples, the colloidal latex coating reservoir 111 may be a tank (not shown) that is connected using a conduit or tube (not shown) to connect the colloidal latex coating reservoir 111 to the coater 110.

The manufacture of the artificial turf 108 is a web-based process where the artificial turf 108 goes through the different stations. After having the colloidal latex coating 112 applied to the underside 114 the artificial turf then goes under an applicator 120. The applicator 120, could for example be a spray bar. The machine may comprise an anti-blistering agent reservoir 121 that may be at least partially filled with the anti-blistering agent 122. The anti-blistering agent reservoir 121 in some examples may be a tank that is connected using a conduit 119 or tube to connect the anti-blistering agent reservoir 121 to the applicator 120.

The applicator 120 is intended to represent any means of applying a small amount of anti-blistering agent 122 to the colloidal latex coating on the underside 114.

The artificial turf within the box 107 has passed under the applicator 120. Here it can be seen that the anti-blistering agent 122 at least partially covers or wets an exposed surface 124 of the colloidal latex coating 112. The applicator is configured to wet a region 123 of the exposed surface 124. Next, the artificial turf 108 passes through a heater 126. The heater has an entrance 125 and an exit 127. The applicator may be configures such that the region 123 of the exposed surface that has just been wet is a distance 129 from the entrance 125 of the heater 126. Controlling the distance 129 enables control over how long the anti-blistering agent 122 is on the exposed surface before the artificial turf 108 enters into the heater 126.

The heater 126 removes water from the colloidal latex coating 112 turning it into a solid latex coating 128. When the artificial turf 108 exits the heater 126 the manufacturing is finished. In some instances the artificial turf fibers 104 may be trimmed after leaving the heater 126. However, this is not necessarily required.

The heater 126 could function in different ways. In this example the heater 126 has a first heat control element and a second heat control element 132. The first heat control element 130 generates forced air 134 with a first temperature range and the second heat control element 132 generates forced air 136 with a second temperature range. In this way the temperature of the underside can be different from that of the artificial turf surface during the curing process. This may lead to effective removal of water from the colloidal latex coating while protecting the artificial turf fibers 104.

Figure 3:
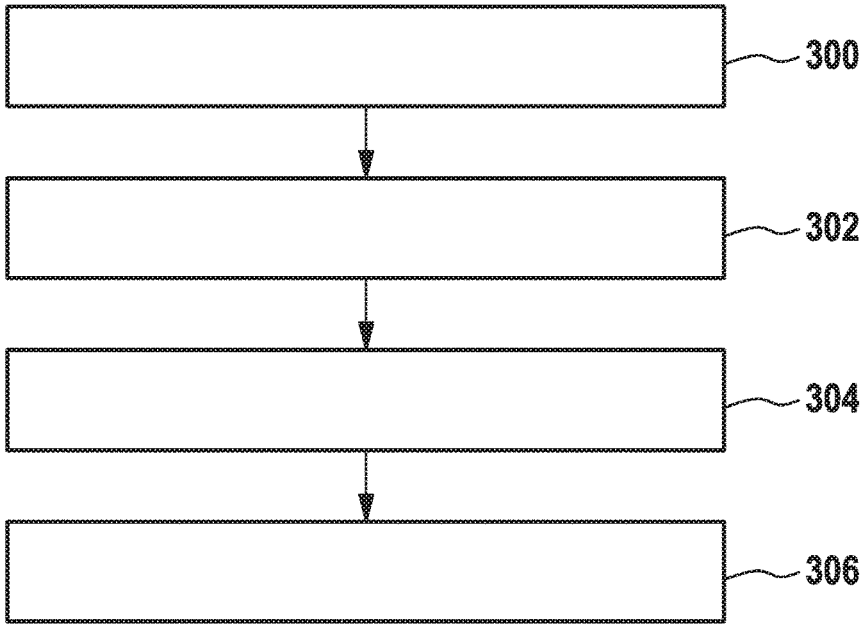
FIG. 3 shows a flow chart which illustrates a method of operating the machine of FIG. 1.

FIG. 3 shows a flowchart which illustrates the operation of the machine 100 shown in FIG. 1. First in step 300 artificial turf fiber 104 is incorporated into an artificial turf backing 102 by the fiber inserter 106 to form the artificial turf 108. Next in step 302 an underside 114 of the artificial turf 108 is coated with a colloidal latex coating 112 using the coater 110. Next in step 304 an exposed surface 124 of the colloidal latex coating 112 is at least partially wet or coated with a applicator 120. Next in step 306 a heater 126 is used to heat at least the underside 114 of the artificial turf 108 to cure the colloidal latex coating 112 into the solid latex coating 128.

Several experiments have been performed using citric acid as the anti-blistering agent. In the experiment where 20% and 40% citric acid solution was sprayed onto a colloidal latex compound prior to drying. In these tests the About 40-50 g $m^2$ of was applied during these experiments. In the experiments the blistering, the drying speed, which is related to turbidity and relative humidity, and tuft lock were examined. The colloidal latex compound examined was a styrene-butadiene latex. The results of the blistering are given qualitatively in table number 1. In table 1 it can be seen that the amount of blistering with no citric acid is the largest. With 20% solution the amount of blistering was reduced. With the 40% solution of citric acid the blistering was further reduced.

TABLE 1

| Citric Acid | Blistering |
|---|---|
| — | ++ |
| 20% solution | + |
| 40% solution | +− |

Table 2 shows the results of experiments when examining the turbidity. The results are shown as 2 minutes, 3 minutes, 4 minutes, 5 minutes, and 6 minutes. As the colloidal latex coating becomes more dry the turbidity decreases. Measuring the turbidity is in effect one measure of determining how rapidly the colloidal latex coating is drying. It can be seen that as the concentration of the citric acid increases the turbidity also decreases. This indicates that the citric acid increases the drying rate of the colloidal latex coating. This may help increase the rate at which the tufted surface covering is manufactured thereby reducing the cost.

TABLE 2

| Citric Acid | 2' | 3' | 4' | 5' | 6' |
|---|---|---|---|---|---|
| — | +++ | +++ | + | +− | − |
| 20% | +++ | +++ | +− | − | − |
| 40% | +++ | +− | − | − | − |

Table 3 shows the relative humidity as a function of time and the amount or concentration of citric acid sprayed on the surface. The results of table 3 shows that spraying citric acid on the colloidal latex coating did not seem to have an appreciable effect on the decrease of relative humidity. However, an additional test was performed by spraying more citric acid on the compound. This was about 200 g /$m^2$ of the 40% solution was applied. The relative humidity after 14 minutes in this case was only 10%. From this additional experiment it can be seen that the application of an acidic anti-blistering agent does indeed have an effect on the relative humidity and therefore the drying rate. This may therefore be used to accelerate the manufacturing process or speed the manufacturing of the tufted surface covering.

TABLE 3

| Time | No anti-blistering agent | 20% Citric Acid | 40% Citric Acid |
|---|---|---|---|
| 14' | 90% | 80% | 90% |
| 16' | 80% | 70% | 80% |
| 18' | 70% | 70% | 70% |
| 20' | 30% | 30% | 30% |
| 22' | 10% | 10% | 10% |

Table 4 illustrates the tuft lock/tuft bind of the finished tufted surface covering. This is performed for the same colloidal latex coating with a control group citric acid of 20% and citric acid of 40% as before. The dry tuft lock experiments is the amount of weight needed to pull a tuft of fibers from the tufted surface covering under dry conditions. The wet tuft lock is performed after the artificial turf has been wet for a period of 24 hours. From this table it can be seen that spraying citric acid on the colloidal latex coating before the curing of the colloidal latex coating into the solid latex coating does not have a detrimental effect on the tuft lock. This is in contrast to the current method of mixing an anti-blistering agent in with the colloidal latex coating. This indicates that spraying the anti-blistering agent on the surface may result in a superior tufted surface covering.

TABLE 4

| Citric Acid | Dry tuft lock | Wet tuft lock (24 hr) |
|---|---|---|
| — | 5.0 kg | 5.2 kg |
| 20% solution | 5.1 kg | 5.4 kg |
| 40% solution | 5.0 kg | 4.9 kg. |

In conclusion, these experiments indicate that spraying citric acid on the colloidal latex coating may improve sensitivity towards blistering and turbidity. Air may not have an effect on the decrease of relative humidity unless a larger concentration of citric acid is applied. Spraying citric acid on the colloidal latex coating does not seem to have a detrimental effect on the tuft lock, it some cases it may change the appearance of the colloidal latex coating because a white brittle residue may be deposited on the surface of the colloidal latex coating. This however does not affect the end product as the underside of tufted surface covering is for example placed on the ground where it is not visible.

Figure 4:
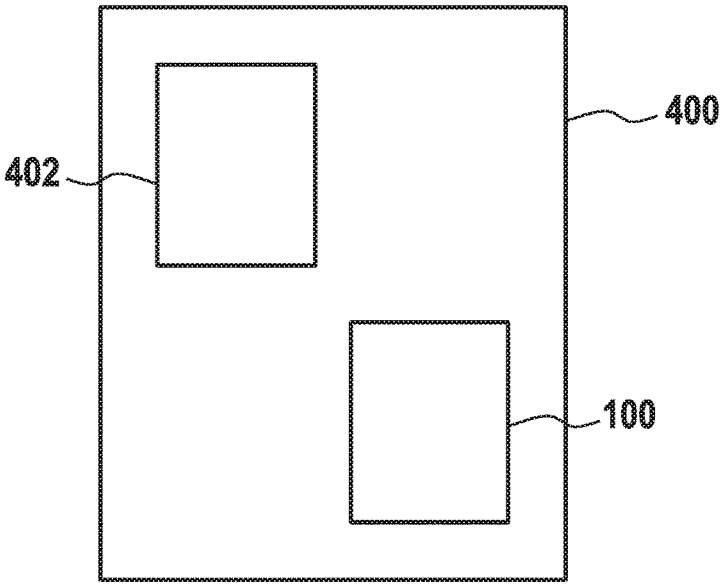
FIG. 4 illustrates an example of manufacturing system.

FIG. 4 illustrates an example of a manufacturing system 400 for manufacturing artificial turf 108. The manufacturing system 400 comprises the machine 100 and an artificial turf fiber apparatus 402. The artificial turf fiber apparatus comprises: a polymer mixer configured for creating a polymer mixture, wherein the polymer mixture comprises at least one polymer; an extruder configured for extruding the polymer mixture into a monofilament; a quencher for quenching the monofilament after extrusion; a heater for reheating the monofilament after quenching; and a fiber stretcher for stretching the reheated monofilament to align the fibers relative to each other and to form the monofilament into the artificial turf fiber. The artificial turf fiber appraratus may also be used to add a nucleation agent to the polymer mixture.

LIST OF REFERENCE NUMERALS

100 machine
102 artificial turf backing
104 artificial turf fiber
106 fiber inserter
108 artificial turf
110 coater
111 colloidal latex coating reservoir
112 colloidal latex coating
114 underside
116 artificial turf surface
118 rotating element
119 conduit
120 applicator
121 anti-blistering agent reservoir
122 anti-blistering agent
123 region of exposed surface
124 exposed surface
125 entrance
126 heater
127 exit
128 solid latex coating
129 distance
130 first heat control element
132 second heat control element
134 forced air within first temperature range
136 forced air within second temperature range
300 incorporating artificial turf fiber into an artificial turf backing to form the artificial turf
302 coating the underside with a colloidal latex coating
304 wetting the exposed surface with an anti-blistering agent that comprises at least one acid
306 heating the underside to cure the colloidal latex coating into a solid latex coating
400 manufacturing system
402 artificial turf apparatus

The invention claimed is:

1. A machine for manufacturing artificial turf, wherein the machine comprises:

a fiber inserter configured for incorporating artificial turf fiber into an artificial turf backing to form the artificial turf, wherein the artificial turf comprises an underside and an artificial turf surface;

a coater configured for coating the underside with a colloidal latex coating, wherein the colloidal latex coating has an exposed surface;

an applicator configured for wetting the exposed surface of the colloidal latex coating with an anti-blistering agent, wherein the applicator is configured for spraying, or atomizing, or aerosoling the anti-blistering agent onto the exposed surface; and a heater configured for heating the underside to cure the colloidal latex coating into a solid latex coating.

2. The machine of claim 1, wherein the coater comprises a lick roll or the coater comprises a dispenser configured for dispensing the colloidal latex coating with a knife over roll applicator for leveling the dispensed colloidal latex.

3. The machine of claim 1, wherein the heater comprises a first heat control element for maintaining a first temperature range across the underside, wherein the heater comprises a second heat control element for maintaining a second temperature range across the artificial turf surface, and wherein the first temperature range is larger than the second temperature range.

4. The machine of claim 3, wherein the first heat control element is a first forced air element, wherein the second heat control element is a second forced air element.

5. The machine of claim 3, wherein the first temperature range is any one of the following: between 140° C. and 150° C., between 130° C. and 160° C., between 120° C. and 170° C., and between 100° C. and 180° C.; and wherein the second temperature range is any one of the following: between 50° C. and 70° C., between 40° C. and 80° C., between 30° C. and 90° C., and between 20° C. and 100° C.

6. The machine of claim 1, wherein the heater comprises a heating element, wherein the heating element is any one of the following: a forced air element, a heat lamp, a resistive heating element, and combinations thereof.

7. The machine of claim 1, wherein the machine is configured for moving the artificial turf backing through the heater continuously, and wherein the applicator is configured for continuously wetting the exposed surface before the artificial turf enters the heater.

8. The machine of claim 7, wherein the machine is configured to move the artificial turf backing through the heater at a rate between 1 meters per minute and 5 meters per minute.

9. The machine of claim 7, wherein the applicator is configured for wetting a region of the exposed surface of the colloidal latex coating with the anti-blistering agent, and wherein the machine is configured for moving the region of the exposed surface into the heater within a time period of 10 seconds to 2 minutes.

10. The machine of claim 7, wherein the applicator is configured for wetting a region of the exposed surface of the colloidal latex coating with the anti-blistering agent, wherein the heater has a heater entrance for the artificial turf, and wherein a distance between the region of the exposed surface and the heater entrance is between 0.15 meters and 10 meters.

11. The machine of claim 1, wherein any one of the following:

the applicator is loaded with the anti-blistering agent;

the machine comprises an anti-blistering agent reservoir filled with the anti- blistering agent, wherein the reservoir is configured to supply the applicator with the anti-blistering agent; and combinations thereof.

12. The machine of claim 11, wherein the anti-blistering agent comprises an acid.

13. The machine of claim 12, wherein the acid is any one of the following: citric acid, vinegar, acetic acid, an alcohol, an organic acid, an inorganic acid, a sulfonic acid, a mineral acid, Formic acid, Acetic acid, Propionic acid, Butyric acid, Valeric acid, Caproic acid, Oxalic acid, Lactic acid, Malic acid, Citric acid, Benzoic acid, Uric acid, Taurine, p-Toluenesulfonic acid, Trifluoromethanesulfonic acid, Aminomethylphosphonic acid, tartaric acid, malic acid, phosphoric acid, hydrochloric acid, hexanedionic acid, and combinations thereof.

14. The machine of claim 11, wherein the anti-blistering agent is a cationic anti-blistering agent.

15. The machine of claim 14, wherein the cationic anti-blistering agent is any one of the following: a salt, sodium chloride, calcium chloride, aluminum chloride, and aluminum sulphate.

16. The machine of claim 14, wherein the cationic anti-blistering agent is any one of the following: a water soluble cationic polymer, Polydiallyldimethylammonium chloride, and Polyethylenimine.

17. The machine of claim 1, wherein the coater is loaded with the colloidal latex coating, wherein the colloidal latex coating comprises a temperature sensitive latex coagulant.

18. The machine of claim 17, wherein the temperature sensitive latex coagulant comprises any one of the following: a silicone polyether and a polyether modified polysiloxane.

19. The machine of claim 1, wherein the machine is configured for continually processing artificial turf backing into the artificial turf.

20. The machine of claim 1, wherein the machine is loaded with the artificial turf fiber, wherein the artificial turf fiber comprises a polymer mixture comprising at least one polymer, and wherein the artificial turf fiber is a stretched artificial turf fiber.

21. The machine of claim 20, wherein the polymer mixture further comprises a nucleating agent for crystallizing the at least one polymer.

22. The machine of claim 21, wherein the nucleating agent is an inorganic substance and/or an organic substance or a mixture thereof, wherein the inorganic substance acting as the nucleating agent consists of one or more of the following:

talcum;

kaolin;

calcium carbonate;

magnesium carbonate;

silicate;

silicic acid;

silicic acid ester;

aluminium trihydrate;

magnesium hydroxide;

meta- and/or polyphosphates; and coal fly ash;

wherein the organic substance acting as the nucleating agent consists of one or more of the following:

1,2-cyclohexane dicarbonic acid salt;

benzoic acid;

benzoic acid salt;

sorbic acid; and sorbic acid salt.

23. A manufacturing system comprising the machine of claim 20 and an artificial turf fiber apparatus, wherein the artificial turf fiber apparatus comprises:

a polymer mixer configured for creating a polymer mixture, wherein the polymer mixture comprises at least one polymer;

an extruder configured for extruding the polymer mixture into a monofilament;

a quencher for quenching the monofilament after extrusion;

a heater for reheating the monofilament after quenching; and a fiber stretcher for stretching the reheated monofilament to align fibers of the reheated monofilament relative to each other and to form the monofilament into the artificial turf fiber.

* * * * *